US006424723B1

(12) United States Patent
Jing

(10) Patent No.: US 6,424,723 B1
(45) Date of Patent: Jul. 23, 2002

(54) MICROPHONE HOLDER FOR MOUNTING A MICROPHONE ON A DRUM

(75) Inventor: Panding Jing, Taipei (TW)

(73) Assignee: Yoga Electronics Co., Ltd., Taipei (TW)

( * ) Notice: Subject to any disclaimer, the term of this patent is extended or adjusted under 35 U.S.C. 154(b) by 204 days.

(21) Appl. No.: 09/631,109

(22) Filed: Aug. 1, 2000

(51) Int. Cl.[7] ..... H04R 25/00
(52) U.S. Cl. ..... 381/361; 381/366; 984/365
(58) Field of Search ..... 381/355, 361, 381/362, 363, 364, 365, 366, 368, FOR 148; 84/733; 984/365

(56) References Cited

U.S. PATENT DOCUMENTS 2,171,430 A * 8/1939 Kislingburg ..... 381/361
3,665,490 A * 5/1972 Oskar ..... 381/366
4,495,641 A * 1/1985 Vernino ..... 381/361
4,570,522 A * 2/1986 May ..... 984/365
4,577,070 A * 3/1986 Shulman ..... 381/366

* cited by examiner

*Primary Examiner*—Stella Woo
*Assistant Examiner*—Suhan Ni
(74) *Attorney, Agent, or Firm*—Morgan, Lewis & Bockius LLP

(57) ABSTRACT

A microphone holder for mounting a microphone on a drum includes a vertical plate having an inner side surface which is adapted to face the drum, and a microphone connecting device, a clip member, and a positioning plate connected fixedly to the vertical plate. The microphone connecting device is adapted to hold the microphone thereon. The clip member clamps a vertical bolt that interconnects a drum body and a drum skin frame. The positioning plate is disposed above the clip member, and has a horizontal top plate section with a bottom surface that is adapted to abut against an upper end of the vertical bolt, and two vertical side plate sections which extend respectively and integrally from two opposite sides of the top plate section, and which are adapted to flank a projection on the drum skin frame through which the vertical bolt extends so as to prevent rotation of the clip member on the vertical bolt.

4 Claims, 3 Drawing Sheets

MICROPHONE HOLDER FOR MOUNTING A MICROPHONE ON A DRUM

BACKGROUND OF THE INVENTION

1. Field of the Invention

The invention relates to a microphone holder for mounting a microphone on a drum, more particularly to a microphone holder that is convenient to use and carry, and that can be mounted conveniently and closely to the drum to obtain a better sound pick-up effect.

2. Description of the Related Art

To record a live musical performance, microphones are needed. To obtain the best sound pick-up effect, the microphones have to be mounted as near to the musical instruments as possible. When mounting a microphone on a drum, for instance, a microphone holder is used. A conventional microphone holder includes an upright stand, and has a clamping end for clamping the microphone such that the direction and angle thereof are adjustable. Some drawbacks associated with the conventional microphone holder are as follows:

1. As the conventional microphone holder has to be erected on the floor, it occupies a relatively large amount of space, and is inconvenient to move around.

2. The conventional microphone holder is relatively heavy and is inconvenient to carry around.

3. The mounting of the microphone on the microphone holder and adjustment of the position of the microphone thereon are troublesome.

4. Since the conventional microphone holder stands on the floor beside the musical instrument, the sound pick-up effect is not satisfactory.

SUMMARY OF THE INVENTION

Therefore, the main object of the present invention is to provide a microphone holder for mounting of a microphone on a drum which is convenient to use and carry, and which can be mounted conveniently and closely to the drum to obtain a better sound pick-up effect.

Accordingly, the microphone holder of the present invention is adapted to mount a microphone on a drum. The microphone includes a microphone body, a connector which is connected pivotally to the microphone body, an electrical cable which is connected to the microphone body, and a headed horizontal bolt which engages threadedly the connector. The drum includes a hollow drum body formed with a lower projection which has a threaded hole, a drum skin frame formed with an upper projection which has a through hole and which is located over the lower projection, and a headed vertical bolt which extends through the through hole in the upper projection to engage the threaded hole in the lower projection. The microphone holder includes a vertical plate having an inner side surface which is adapted to face the drum, and an outer side surface which is opposite to the inner side surface. A microphone connecting device is connected fixedly to the vertical plate, and is adapted to hold the microphone thereon. A clip member is connected fixedly to the vertical plate, and is adapted to clamp the vertical bolt thereon. An inverted U-shaped positioning plate is connected fixedly to the vertical plate, and is disposed over the clip member. The positioning plate has a horizontal top plate section with a bottom surface that is adapted to abut against an upper end of the vertical bolt, and two vertical side plate sections which extend respectively and integrally from two opposite sides of the top plate section and which are adapted to flank the upper projection of the drum so as to prevent rotation of the clip member on the vertical bolt.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
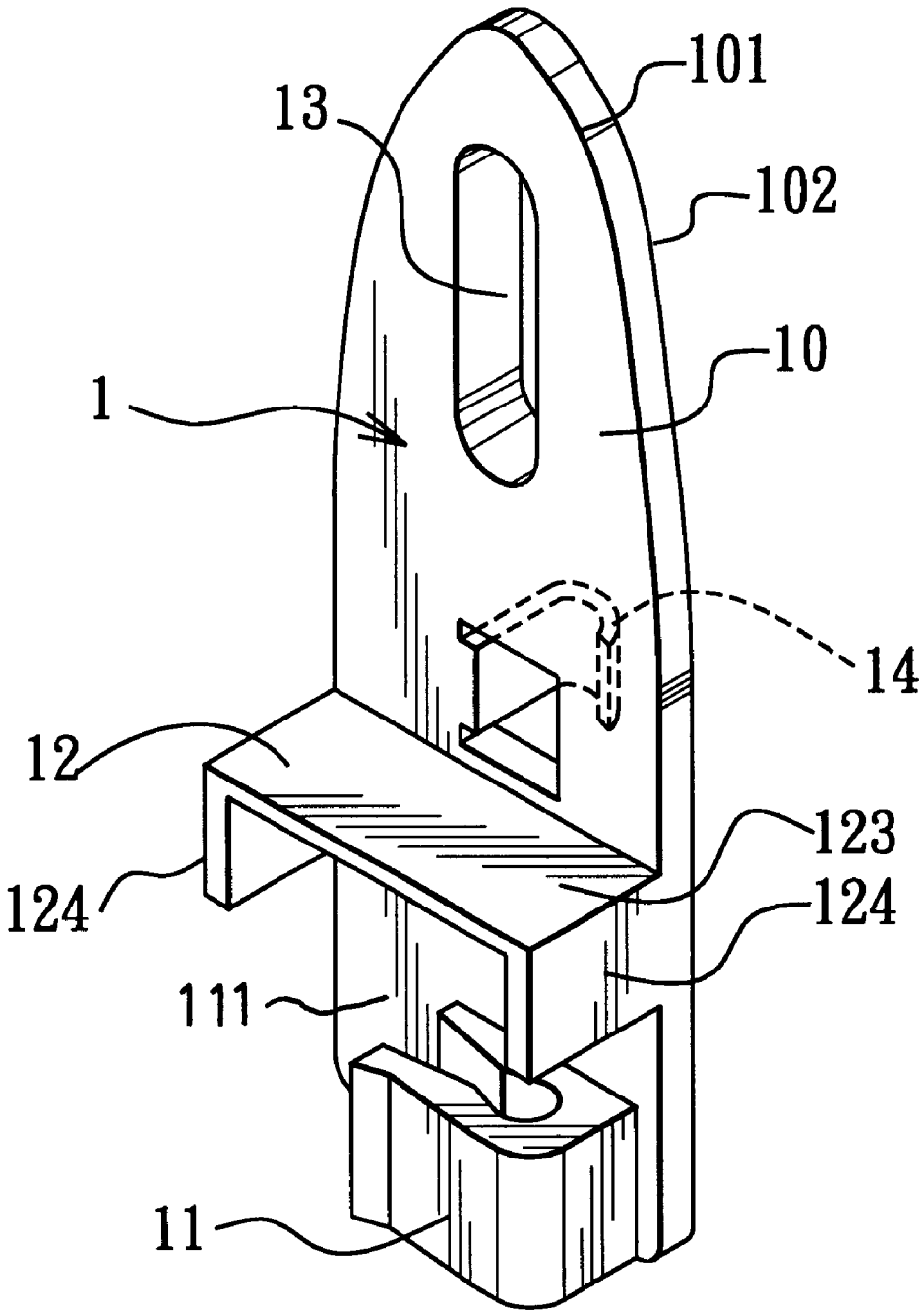
FIG. 1 is a perspective view of a preferred embodiment of microphone holder according to the invention.
Figure 2:
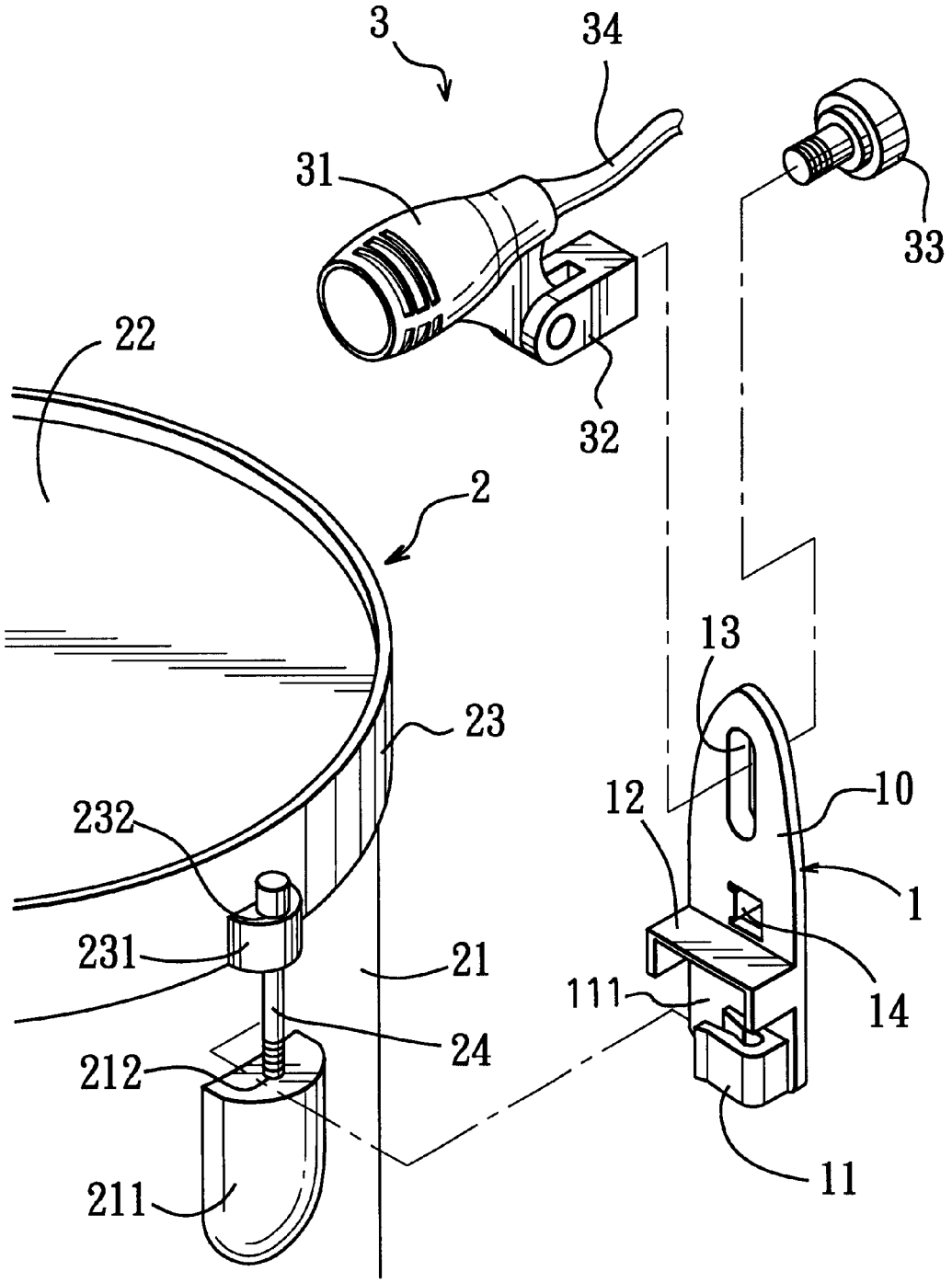
FIG. 2 is a fragmentary exploded view illustrating how the preferred embodiment mounts a microphone on a drum.
Figure 3:
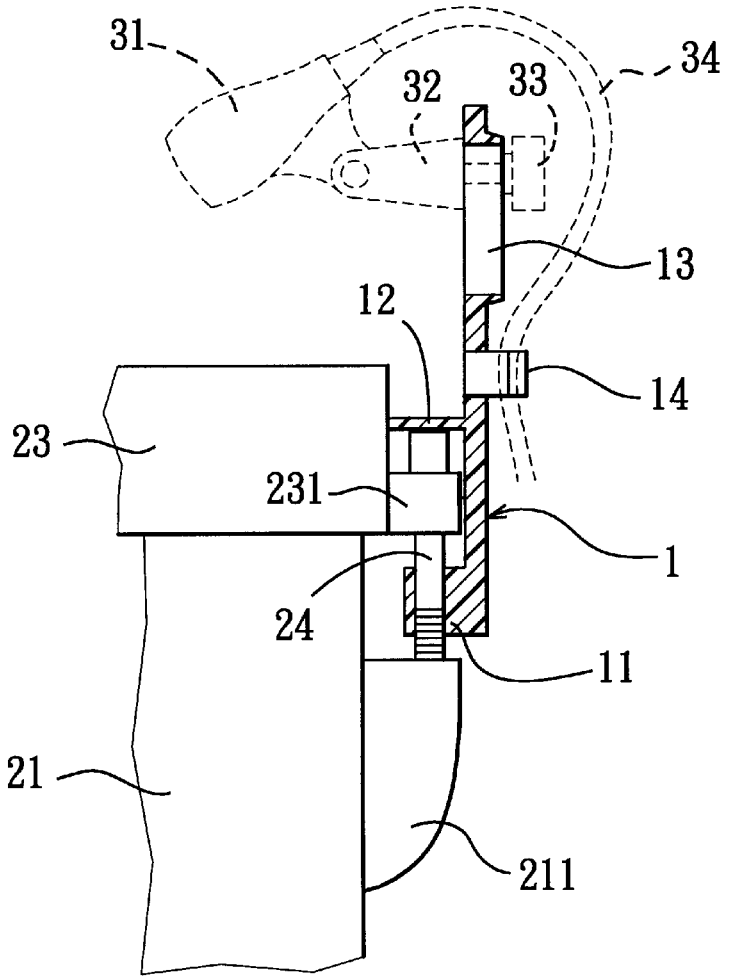
FIG. 3 is a schematic partly sectioned view of the preferred embodiment in a state of use.

Referring to FIGS. 1, 2 and 3, the preferred embodiment of a microphone holder 1 according to the present invention is shown to be adapted for mounting a microphone 3 on a drum 2. As shown, the microphone 3 includes a microphone body 31, a connector 32 which is connected pivotally to the microphone body 31, an electrical cable 34 which is connected to the microphone body 31, and a headed horizontal bolt 33 which engages threadedly the connector 32. The drum 2 includes a hollow drum body 21 formed with a lower projection 211 which has a threaded hole 212, a drum skin frame 23 adapted for mounting of a drum skin 22 and formed with an upper projection 231 which has a through hole 232 and which is located over the lower projection 211, and a headed vertical bolt 24 which extends through the through hole 232 in the upper projection 231 to engage the threaded hole 212 in the lower projection 211 so as to secure the drum skin frame 23 firmly in position.

Figure 4:
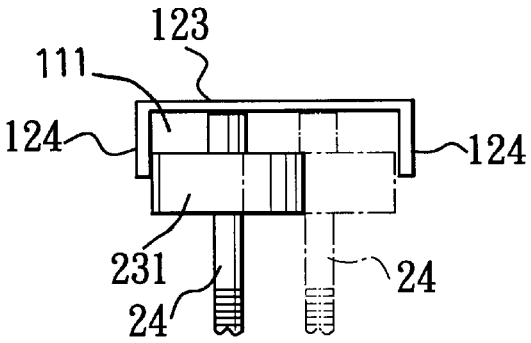
FIG. 4 is a schematic view illustrating the position of a positioning plate of the preferred embodiment relative to a vertical bolt of the drum in the state of use.

The microphone holder 1 is shown to include a vertical plate 10, a microphone connecting device, a clip member 11, and a positioning plate 12. The vertical plate 10 has an inner side surface 101 which is adapted to face the drum 2, and an outer side surface 102 which is opposite to the inner side surface 101. The clip member 11 is connected fixedly to the vertical plate 10, and is adapted to clamp the vertical bolt 24 thereon. The positioning plate 12 is also connected fixedly to the vertical plate 10, and is disposed over the clip member 11. In this embodiment, the positioning plate 12 is generally inverted U-shaped, and has a horizontal top plate section 123 with a bottom surface that is adapted to abut against an upper end of the vertical bolt 24, and two vertical side plate sections 124 which extend respectively and integrally from two opposite sides of the top plate section 123, and which are adapted to flank the upper projection 231 on the drum skin frame 23 so as to prevent rotation of the clip member 11 on the vertical bolt 24, as shown in FIG. 4. The clip member 11 and the positioning plate 12 are made of plastic, and are preferably formed integrally on the inner side surface 101 of the vertical plate 10.

The microphone connecting device is connected fixedly to the vertical plate 10, and is adapted to hold the microphone 3 thereon. In this embodiment, the microphone connecting device includes a vertical side slot 13 formed through an upper end portion of the vertical plate 10 and located above the positioning plate 12, thereby permitting extension of the horizontal bolt 33 therethrough for locking the connector 32 on the vertical plate 10. As such, the position of the microphone 3 can be adjusted vertically relative to the drum 2.

The microphone connecting device further includes a hook member 14 which is formed integrally on the outer side surface 102 of the vertical plate 10 and which is adapted to permit extension of the electrical cable 34 therethrough. Therefore, the electrical cable 34 can be positioned relative to the drum 2, and can be prevented from contacting the drum 2 upon rotation of the microphone body 31. In addition, the clip member 11 is disposed substantially to the right side of the vertical plate 10 under the positioning plate 12 such that a space 111 is left in the vertical plate 10 under the left side of the positioning plate 12 for accommodating the upper projection 231 and the upper end of the vertical bolt 24 during mounting of the microphone holder 1 on the drum 2.

To mount the microphone holder 1 on the drum 2, the microphone holder 1 is placed on the drum 2 in such a manner that the upper projection 231 is disposed in the space 111 in the vertical plate 10, as shown in the solid lines in FIG. 4. Then, the microphone holder 1 is pushed to the position shown in the phantom lines in FIG. 4, where the vertical bolt 24 is clamped by the clip member 11. As such, the bottom surface of the top plate section 123 of the positioning plate 12 abuts against the upper end of the vertical bolt 24, and the side plate sections 124 of the positioning plate 12 flank the upper projection 231 to prevent rotation of the clip member 21 on the vertical bolt 24. Then, the connector 32 of the microphone 3 is brought to be disposed near the slot 13 in the vertical plate 10, and the horizontal bolt 33 is extended through the slot 13 to engage threadedly the connector 32 so as to lock the connector 32 on the vertical plate 10. The horizontal bolt 33 can be operated to displace upwardly and downwardly along the slot 13 to permit adjustment of the position of the microphone 3. As such, the microphone 3 can be mounted very close to the drum skin 22.

Hence, the microphone holder 1 of the present invention has the following advantages:

1. The microphone holder 1 is compact and light-weight, and is convenient to carry around.

2. The microphone holder 1 is easy to mount on the drum. Besides, it is convenient to adjust the position of the microphone 3 mounted thereon.

3. Since the microphone holder 1 can be mounted very close to the drum 2, a better sound pick-up effect can be obtained.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A microphone holder adapted to mount a microphone on a drum, the microphone including a microphone body, a connector which is connected pivotally to the microphone body, an electrical cable which is connected to the microphone body, and a headed horizontal bolt which engages threadedly the connector, the drum including a hollow drum body formed with a lower projection which has a threaded hole, a drum skin frame formed with an upper projection which has a through hole and which is located over the lower projection, and a headed vertical bolt which extends through the through hole in the upper projection to engage the threaded hole in the lower projection, said microphone holder comprising:

a vertical plate having an inner side surface which is adapted to face the drum, and an outer side surface which is opposite to said inner side surface;

a microphone connecting device connected fixedly to said vertical plate and adapted to hold the microphone thereon;

a clip member connected fixedly to said vertical plate and adapted to clamp the vertical bolt thereon; and an inverted U-shaped positioning plate connected fixedly to said vertical plate and disposed over said clip member, said positioning plate having a horizontal top plate section with a bottom surface that is adapted to abut against an upper end of the vertical bolt, and two vertical side plate sections which extend respectively and integrally from two opposite sides of said top plate section and which are adapted to flank the upper projection of the drum so as to prevent rotation of said clip member on the vertical bolt.

2. The microphone holder as claimed in claim 1, wherein said microphone connecting device includes a vertical side slot which is formed through an upper end portion of said vertical plate and which is located above said positioning plate, thereby permitting extension of the horizontal bolt therethrough for locking the connector on said vertical plate, whereby the position of the microphone can be adjusted vertically relative to the drum.

3. The microphone holder as claimed in claim 2, wherein said microphone connecting device further includes a hook member which is connected fixedly to said vertical plate so as to be adapted to permit extension of the electrical cable therethrough, whereby the electrical cable is positioned relative to the drum.

4. The microphone holder as claimed in claim 3, wherein said clip member and said positioning plate are made of plastic, and are formed integrally on said inner side surface of said vertical plate, said hook member being formed integrally on said outer side surface of said vertical plate.

* * * * *